US005143746A

United States Patent [19]

Inoue et al.

[11] Patent Number: 5,143,746

[45] Date of Patent: Sep. 1, 1992

[54] PROCESS FOR PRODUCING MAGNETITE-COATED ELECTRODE

[75] Inventors: Hideo Inoue, Urawa; Setsuo Yoshimoto; Sakae Ikegami, both of Tanouramachi, all of Japan

[73] Assignee: Tokai Carbon Co., Ltd., Tokyo, Japan

[21] Appl. No.: 650,279

[22] Filed: Feb. 4, 1991

[30] Foreign Application Priority Data

Feb. 5, 1990 [JP] Japan ..... 2-26772

[51] Int. Cl.[5] ..... B05D 1/00

[52] U.S. Cl. ..... 427/34; 264/63; 264/65; 264/67; 427/128; 427/131

[58] Field of Search ..... 427/128–132, 427/48, 34, 224, 423, 427, 216; 264/63, 65, 67

*Primary Examiner*—Bernard Pianalto

*Attorney, Agent, or Firm*—Armstrong & Kubovcik

[57] ABSTRACT

A process for producing a magnetite-coated electrode which comprises kneading an iron oxide powder, water and an organic binder under pressure sufficient to prepare a molded article, baking the molded article in a gas atmosphere mainly composed of a member selected from the group consisting of carbon dioxide and steam to prepare a magnetite sinter having an Fe to 0 ratio of 3:3.7 to 4.0, pulverizing the sinter to prepare a powder, and subjecting a metallic substrate to plasma spray coating, plasma jet spray coating, explosive spray coating and water plasma spray coating by making use of the powder as the spray coating source in a neutral gas atmosphere to form a magnetite coating on the surface of the metallic substrate.

9 Claims, No Drawings

PROCESS FOR PRODUCING MAGNETITE-COATED ELECTRODE

BACKGROUND OF THE INVENTION

The present invention relates to a process for producing a magnetite-coated electrode which exhibits an excellent durability when used in electrolysis, etc., under severe conditions.

Various oxide materials have hitherto drawn attention as a material suitable for an insoluble electrode for use in various types of electrolysis, etc. Among them, magnetite has been believed to be the most practical material.

Magnetite is a ferromagnetic substance having an inverse spinel structure and a composition of $Fe_3O_4$ and exhibits excellent electrical conductivity and corrosion resistance.

Accordingly, a magnetite powder has been molded into a columnar, plate or cylindrical article by casting or sintering for use as an electrode.

Later on, an electrode made from a metallic material having excellent workability and electrical conductivity and coated with magnetite has been developed for the purpose of further improving the workability and electrical conductivity of the magnetite electrode.

For example, Japanese patent application Kokai publication No. 53-103980 discloses a process for producing a magnetite-coated electrode which comprises subjecting an electrically conductive, corrosion-resistant metal substrate, such as titanium, zirconium, tantalum or niobium, to plasma spray coating by making use of a magnetite powder having a composition comprising $Fe_2O_3$ and FeO in an $Fe_2O_3$ to FeO weight ratio of 2.4 to 2.8 in a gas stream of a reducing atmosphere to coat the substrate with magnetite, immersing the coated substrate in an aqueous iron salt solution under a reduced pressure, and heating the immersed coated substrate in a mixed gas mainly composed of steam at a temperature of 550° to 700° C.

This method, however, involves a complicated process and further has the following drawbacks due to the use of cast magnetite, natural magnetite or synthetic magnetite as the spray coating source.

Specifically, the cast magnetite and natural magnetite contain large amounts of impurities such as silica, which causes the resultant magnetite coating to become porous, the strength to be lowered and the electrical specific resistance to be enhanced.

The synthetic magnetite is usually in the form of an ultrafine particle having a size of 1 μm or less. Therefore, it clogs the pipe of a powder feeder, so that the spray coating becomes impossible. In this case, even if the spray coating could be conducted with difficulty, the adhesion of the powder lowers or the resultant coating is so dense that the internal stress increases and peeling may occur, which makes it difficult to form a thick coating.

In the present invention, the above-described problems are solved by utilizing a pulverized magnetite sinter prepared under particular conditions as the spray coating source.

SUMMARY OF THE INVENTION

An object of the present invention is to provide a process for producing a magnetite-coated electrode having a stable magnetite coating having excellent strength and electrical conductivity formed on a metallic substrate.

The process for producing a magnetite-coated electrode according to the present invention by which the above-described object can be attained comprises molding an iron oxide powder under pressure to prepare a molded article, baking the molded article in a gas atmosphere mainly composed of a member selected from the group consisting of carbon dioxide and steam to prepare a magnetite sinter having an Fe to O ratio of 3:3.7 to 4.0, pulverizing the sinter to prepare a powder, and subjecting a metallic substrate to spray coating by making use of the powder as the spray coating source in a neutral gas atmosphere to form a magnetite coating on the surface of the metallic substrate.

PREFERRED EMBODIMENTS

In the present invention, a magnetite sinter is prepared first and the sinter is then pulverized to prepare a magnetite sinter powder.

The preparation of the magnetite sinter is conducted by heat-sintering a molded article prepared through molding of an iron oxide powder such as $Fe_2O_3$, FeO or $Fe_3O_4$ under pressure.

When the above-described iron oxide powder is directly sintered, the resultant sinter is porous. The use of a powder of the porous sinter as the spray coating source which will be described later causes a porous coated film to be formed, which brings about a lowering in the film strength and peeling of the film.

In order to form a dense spray coated film, it is necessary to first mold an iron oxide powder under pressure.

The iron oxide powder may be either a mixture of $Fe_2O_3$ with FeO or $Fe_3O_4$ alone.

When the mixture of $Fe_2O_3$ with FeO is used, there is no particular problem on the mixing ratio. However, the larger the difference between the Fe to O ratio of the starting iron oxide mixture and the Fe to O ratio of 3:3.7 to 4.0 of the magnetite sinter, the longer should be the sintering time so as to regulate the Fe to O ratio of the resultant sinter to be 3:3.7 to 4.0.

The particle diameter of the iron oxide powder is preferably 20 μm or less. The purity of the iron oxide is preferably 95% or more. When the particle diameter is larger than 20 μm, it becomes so difficult to conduct sintering that no dense sinter can be obtained and therefore the spray-coated film is apt to peel off. On the other hand, when the purity is less than 95%, the strengths of both the sinter and the spray-coated film are lowered and the electrical specific resistance is increased.

The molding is conducted by kneading an iron oxide powder together with water and organic binder (polyvinyl alcohol, phenol, glycerin, etc.), drying the mixture, regulating the particle size to a suitable one, and molding the powder having a regulated particle size by means of a mold or CIP under pressure.

The sintering is conducted in a gas atmosphere mainly composed of carbon dioxide or steam. Specifically, a gas mainly composed of carbon dioxide or steam is used for the purpose of maintaining the partial pressure of oxygen in a proper range. More specifically, the sintering is conducted in a gas atmosphere selected from the group consisting of carbon dioxide alone, a mixed gas comprising carbon dioxide and a minor amount of carbon monoxide, steam alone, and a mixed gas comprising steam and a minor amount of hydrogen gas.

The sintering temperature is 900° C. or above, preferably 950° to 1400° C. Thus, a magnetite sinter having an Fe to O compositional ratio of 3:3.7 to 4.0 can be prepared.

In the Fe to O compositional ratio, when O is less than 3.7, the strength characteristics lower. On the other hand, when O exceeds 4.0, the electrical specific resistance gets higher.

The resultant magnetite sinter is pulverized to prepare a magnetite sinter powder. This powder is used as the spray coating source for the surface of a metallic substrate which will be described later. Although the particle diameter of the powder obtained by pulverization affects the properties of the magnetite coating formed by spray coating, a good magnetite coating can be formed by regulating the particle size to a fine particle size range of 5 to 150 μm depending upon the melt spray coating means used.

The metallic substrate to be coated with a magnetite coating may be in any form, and is preferably a metal having a combination of electrical conductivity with corrosion resistance, such as titanium, zirconium, tantalum and niobium, except for the use as an anode in organic electrolysis and a cathode in electrolysis of an aqueous solution. This is because if a material having poor corrosion resistance, such as steel material, is used as the substrate, a solution infiltrating through micropores or cracks formed in a magnetite-coated film provided by spray coating accelerates the erosion of the material.

All the above-described metallic materials are expensive and in addition inferior to the steel material in the workability, so that it often becomes difficult to conduct molding when a complicated shape is intended.

In order to eliminate the above-described drawback, it is preferred to use as the metallic substrate a material comprising a titanium layer formed on the surface of nickel, stainless steel or ordinary steel material.

The titanium layer is formed by the same spray coating means as that used in the step of forming a magnetite coating which will be described later, through the use of a metallic titanium or titanium hydride powder as a starting material.

The thickness of the titanium layer formed should be about 100 μm or more although it depends upon the unevenness of the substrate or the particle diameter of titanium. When the thickness is less than 100 μm, delamination often occurs during use of the product.

Various types of industrial powder spray coating means can be used for the spray coating of the surface of a metallic substrate with magnetite. The spray coating is conducted in a neutral gas atmosphere not having an extreme oxidizing or reducing nature.

For example, in the case of usual plasma spray coating or plasma jet spray coating, use is made of argon, nitrogen or a mixed gas thereof as a working gas. In this case, it is necessary to weaken the reducing power of the working gas through exclusion of hydrogen usually employed in combination with the above-described gas. When an explosive spray coating called "D-gun or J-gun" is utilized, an excessively oxidizing or reducing atmosphere is avoided by conducting such an adjustment that complete combustion of acetylene, kerosine or the like is conducted by explosive combustion with an irreducible minimum of the amount of oxygen. When water plasma spray coating is applied, although water plasma decomposed at a high temperature slightly reduces the magnetite powder into FeO, no adverse effect on the electrode performance is observed.

A coated electrode provided with a homogeneous and tough magnetite coating having a thickness exceeding 300 μm and formed on the surface of a metallic substrate can be produced through the above-described spray coating treatments.

As described above, according to the present invention, a powder of a sinter prepared by sintering an iron oxide powder molded under pressure in a gas atmosphere mainly composed of carbon dioxide or steam is used as a spray coating source for the formation of a magnetite coating on a metallic substrate by spray coating.

Since a magnetite powder having an Fe or O compositional ratio of 3:3.7 to 4.0 and a combination of good electrical conductivity with good strength characteristics is used as the spray coating source and the spray coating is conducted in a neutral gas atmosphere capable of stably maintaining the above-described composition, it becomes possible to always form a homogeneous, dense, tough magnetite coating having a low resistivity on the surface of a metallic substrate. Therefore, no complicated post-treatment step, such as sealing, is needed after the formation of the coating.

Further, the use of a material comprising a titanium layer formed on a steel material contributes to a remarkable improvement in the workability of the electrode material and, at the same time, a remarkable reduction in the material cost.

The present invention will now be described in more detail by way of the following Examples and Comparative Examples.

EXAMPLES 1 to 3:

0.9 mole of an $Fe_2O_3$ powder was mixed with 1.1 moles of FeO, and a 1% aqueous polyvinyl alcohol solution was added thereto. The mixture was kneaded for 1 to 2 hr and dried at about 80° C. for 24 hr, and the particle size of the dried product was regulated to 20 to 30 μm. The resultant powder was molded under a pressure of 1 ton $cm^2$ into a green compact in a plate form. The green compact was heated for sintering in a carbon dioxide atmosphere at 1100° C.

The resultant sinter had a magnetite structure an Fe to O compositional ratio of 3:3.98 and excellent mechanical strength and electrical conductivity, i.e, a bulk density of 5.1 $g/cm^3$, a bending strength of 1070 $kg/cm^2$ and a resistivity of 0.013 Ωcm.

The magnetite sinter prepared above was pulverized by means of a vibrating mill to prepare spray coating sources having different particle diameters. The whole surface of a substrate of a metallic titanium plate having a width of 150 mm, a length of 500 mm and a thickness of 3 mm was subjected to spray coating by different spray coating means through the use of the spray coating sources prepared above, thereby forming a magnetite coating.

The magnetite-coated electrodes thus produced were subjected to X-ray diffraction analysis and the relative intensities of qualitatively identified components are given in Table 1. No impurity such as silica was detected in the identified components.

Further, each electrode was subjected to an energization test in a 1% saline solution under the conditions of 100 $A/dm^2$ for 50 hr. The results of the electrolysis test are given in Table 2. As is apparent from the results given in Table 2, each magnetite-coated electrode of the Examples was uniformly eroded with a small degree of consumption, and no evidence of corrosion was observed on the structure after the test.

COMPARATIVE EXAMPLE

A magnetite coating was formed on the whole surface of a metallic titanium substrate by means of plasma jet spray coating in the same manner as that of the Examples, except that a cast magnetite was used instead of the magnetite sinter used in Examples 1 to 3.

The magnetite-coated electrode thus produced was subjected to the same test as that conducted in Examples 1 to 3. The results of the X-ray diffraction analysis is given in Table 1, and the results of the electrolysis test is given in Table 2.

TABLE 1

| Identified components | Example 1 | Example 2 | Example 3 | Comp. Ex. |
|---|---|---|---|---|
| $Fe_3O_4$ | ++++ | ++++ | +++ | +++ |
| $\alpha$-$Fe_2O_3$ | + | | | ++ |
| $\alpha$-Fe | ± | | | ± |
| FeO | ± | | ++++ | ++ |
| $Cu_2O$ | | ± | | ± |
| $SiO_2$ | | | | + |

Notes:

Relative intensity ++++ > +++ > ++ > + > ±

As is apparent from Table 1, the magnetite-coated electrode of the Comparative Example contains silica which is an impurity contained in the starting spray coating material and, as is apparent from Table 2, exhibited uneven consumption and partial corrosion in the electrolysis.

EXAMPLES 4 to 8:

Various steel materials having a size of 50 mm in width, 70 mm in length and 5 mm in thickness were used as the substrate material, and a titanium thin layer was formed on the surface of the substrate material by different spray coating processes.

The titanium-coated steel materials thus prepared were used as the substrate, and the surface thereof was subjected to spray coating with the same magnetite sinter powder as that used in the Examples 1 to 3. In this case, however, the spray coating was conducted in the same manner as that described above in connection with the formation of the titanium layer.

The magnetite electrodes thus produced were electrolyzed under the same condition as that of the Examples 1 to 3. The structure of the electrodes after the test was observed, and the results are given in Table 3. As is apparent from Table 3, none of defects such as abnormal erosion or delamination were observed even when materials comprising a titanium layer formed on the steel material were used as an electrode substrate. However, in Example 8 where the thickness of the titanium layer is less than 100 μm, a slight delamination was observed.

TABLE 3

| Ex. | Substrate material (symbol of steel material) | Spray coating conditions: method | Spray coating conditions: spray coating gas | Formation of titanium layer: starting material | Formation of titanium layer: particle diameter (μm) | Formation of titanium layer: film thickness (μm) | Magnetite coating: particle diameter of spray coating source (μm) | Magnetite coating: coating thickness (μm) | Electrode after electrolysis |
|---|---|---|---|---|---|---|---|---|---|
| Ex. 4 | SUS 430 | explosive combustion | — | $TiH_2$ | 10–44 | 100 | 5–40 | about 400 | normal |
| Ex. 5 | SUS 430 | water plasma | steam | Ti | 24–63 | 300 | 40–100 | about 400 | normal |
| Ex. 6 | SUS 304 | plasma | argon | $TiH_2$ | 63–100 | 200 | 40–150 | about 400 | normal |
| Ex. 7 | SS 41 | plasma jet | nitrogen + argon | $TiH_2$ | 24–63 | 150 | 5–40 | about 400 | normal |
| Ex. 8 | SUS 304 | plasma jet | nitrogen + argon | Ti | 24–63 | 80 | 5–40 | about 400 | occurrence of delamination after 30 hr |

As described above, according to the present invention, it is possible to prepare a highly durable magnetite-coated electrode coated with a dense and tough magnetite coating having excellent conductivity. Further, the application of a material comprising a titanium layer formed on the surface of a steel material to the metallic substrate enables the workability to be improved and the material cost to be reduced.

TABLE 2

| Ex. | Spray coating condition: particle diameter of spray coating source (μm) | Spray coating condition: method | Spray coating condition: spray coating gas | Thickness of magnetite coating (μm) | Results of electrolysis test: amt. of consumption (g/A · year) | Results of electrolysis test: electrode after electrolysis |
|---|---|---|---|---|---|---|
| Ex. 1 | 40–150 | plasma | argon | about 150 | 1.3 | uniform erosion |
| Ex. 2 | 5–40 | plasma jet | nitrogen + argon | about 500 | 1.0 | uniform erosion |
| Ex. 3 | 40–150 | water plasma | steam | about 400 | 1.2 | uniform erosion |
| Comp. Ex. | 40–150 | plasma jet | nitrogen + argon | about 500 | 30.5 | uneven erosion and partial corrosion of titanium substrate |

Therefore, the magnetite-coated electrode produced according to the present invention can be expected to be used for a long period of time is extensive fields, such as anodes for electro-osmotic sludge dehydrator, electro-osmotic poor subsoil reinforcement or wet wall drying, and anodes and cathodes for various types of plating, reconvery of noble metals, industrial electrolysis of inorganic substances, organic electrolysis, etc.

What is claimed is:

1. A process for producing a magnetite-coated electrode which comprises kneading an iron oxide powder together with water and an organic binder, molding the resultant kneaded product under pressure sufficient to prepare a molded article, baking the molded article in a gas atmosphere mainly composed of a member selected from the group consisting of carbon dioxide and steam under conditions sufficient to prepare a magnetite sinter having an Fe to O ratio of 3:3.7 to 4.0, pulverizing said sinter to form a powder and spray coating a metallic substrate with said powder by means of plasma spray coating, plasma jet spray coating, explosive spray coating or water plasma spray coating in a neutral gas atmosphere to form a magnetite coating on the surface of the metallic substrate.

2. A process according to claim 1, wherein said iron oxide is at least one member selected from the group consisting of $Fe_2O_3$, FeO and $Fe_3O_4$.

3. A process according to claim 1, wherein said gas selected from the group consisting of carbon dioxide and steam is a gas selected from the group consisting of carbon dioxide alone, a mixed gas comprising carbon dioxide and a minor amount of carbon monoxide, steam alone, and a mixed gas comprising steam and a minor amount of hydrogen gas.

4. A process according to claim 1, wherein said sintering temperature is 950° to 1400° C.

5. A process according to claim 1, wherein the particle diameter of said magnetite sinter powder is 5 to 150 μm.

6. A process according to claim 1, wherein said metallic substrate is a substrate of a metal selected from the group consisting of titanium, zirconium, tantalum and niobium.

7. A process according to claim 1, wherein said metallic substrate comprises a steel material and a titanium coating formed thereon by spray coating.

8. A process according to claim 7, wherein the thickness of said titanium coating is 100 μm or more.

9. A process according to claim 1, wherein said neutral gas is at least one gas selected from the group consisting of argon, nitrogen, a mixed gas comprising argon and nitrogen, and steam.

* * * * *